US005796375A

United States Patent [19]

Holloman

[11] Patent Number: 5,796,375

[45] Date of Patent: Aug. 18, 1998

[54] VIDEO DISPLAY USING FIELD EMISSION TECHNOLOGY

[75] Inventor: Charles J. Holloman, Fairfield, Conn.

[73] Assignee: Trans-Lux Corporation, Norwalk, Conn.

[21] Appl. No.: 691,866

[22] Filed: Aug. 2, 1996

[51] Int. Cl.[6] ..... G09G 3/22

[52] U.S. Cl. ..... 345/74; 345/75

[58] Field of Search ..... 345/74, 75, 60–76, 345/4, 5, 155, 189, 200, 153, 185; 313/309, 497, 482, 495; 315/169.1, 366

[56] References Cited

U.S. PATENT DOCUMENTS

| | | | |
|---|---|---|---|
| 4,965,751 | 10/1990 | Thayer et al. | 345/200 |
| 5,015,912 | 5/1991 | Spindt et al. | 313/495 |
| 5,029,105 | 7/1991 | Coleman et al. | 345/153 |
| 5,063,327 | 11/1991 | Brodie et al. | 313/482 |
| 5,191,259 | 3/1993 | Hayashi et al. | 313/497 |
| 5,202,609 | 4/1993 | Tomii et al. | 315/366 |
| 5,311,211 | 5/1994 | Simpson | 345/189 |
| 5,333,261 | 7/1994 | Guttag et al. | 345/155 |
| 5,347,292 | 9/1994 | Ge et al. | 345/74 |
| 5,402,143 | 3/1995 | Ge et al. | 345/75 |
| 5,517,609 | 5/1996 | Guillemaud et al. | 345/185 |

*Primary Examiner*—Steven Saras
*Assistant Examiner*—David L. Lewis
*Attorney, Agent, or Firm*—Kane, Dalsimer, Sullivan, Kurucz, Levy, Eisele and Richard, LLP

[57] ABSTRACT

The device is a display apparatus which includes an array of tiles. Each tile includes an array of phosphor pixels sealed between an upper sheet of glass and a metallic anode film. Row control gates form an electrode for each row of pixels. Column electrodes are directed to apertures in the row control gates which are positioned under the electrodes. By maintaining the metallic anode film at a high positive potential, and the electrodes at a positive potential, the pixels can be selectively displayed by selectively holding the column electrodes to a zero potential thereby causing electrons to be projected from the column electrode to the metallic anode film.

10 Claims, 6 Drawing Sheets

TABLE

| STATE | ROW | COL | STATUS |
|---|---|---|---|
| 1 | 0 | 0 | OFF |
| 2 | + | 0 | ON |
| 3 | 0 | + | OFF |
| 4 | + | + | OFF |
| BLANK | 0 | 0 | OFF |

VIDEO DISPLAY USING FIELD EMISSION TECHNOLOGY

BACKGROUND OF THE INVENTION

1. Field of the Invention

The present invention pertains to an alphanumeric and graphic video display using field emission technology.

2. Description of the Prior Art

Large-scale pixel-oriented video displays for alphanumeric and video data, including moving images, are required for many applications.

In the prior art, projectors have been used for large scale displays, but this has been unsatisfactory under high ambient light conditions. Moreover, projectors typically cannot provide fine detailed characters and graphics from a computer output.

Similarly, CRT tubes are limited in size by the single vacuum envelope. An array of CRT tubes is not seamless. Likewise, an array of small CRT tubes results in a display which is too large, except for stadiums and similar applications.

Liquid crystal diode (LCD) displays lack brightness and contrast and have a limited viewing angle. Similarly, current light emitting diode (LED) displays are limited in their capability to display blue colors adequately.

OBJECTS AND SUMMARY OF THE INVENTION

It is therefore an object of this invention to provide a large-scale pixel-oriented display system for the display of alphanumeric and fine graphic information and capable of displaying moving images.

It is therefore a further object of this invention to provide a large-scale pixel-oriented display system with a high quality image, with sufficient brightness and contrast, under high ambient light conditions.

It is therefore a still further object of this invention to provide a large-scale display system which can display fine detailed characters and graphics from a computer output.

It is therefore a still further object of this invention to provide a display system which can be made in wide range of sizes while remaining substantially seamless.

It is therefore a still further object of this invention to provide a display system which has a wide range of viewing angles.

It is therefore a final object of this invention to provide a display system which can display a wide range of colors, including blue.

These and other objects are attained by providing a display system which uses light emitting phosphors similar to those used in high brightness CRTs deposited on a glass plate with the red, green and blue phosphors deposited in pie shapes to form a final round dot or pixel. Typically an array comprises sixteen rows of sixteen dots in each row thereby forming a 16 by 16 pixel array. The space between the dots is approximately equal to one half of the pixel diameter which is important in the formation of alphanumeric characters. The space from the outer row of dots to the edge of the glass plate is less than one half of the inter-dot spacing which allows for any number of panels to be assembled into a display while keeping a precise uniform dot spacing (thereby avoiding the appearance of seams). A second plate is fabricated with the field emitters of precisely the same shape as the color phosphor triads, and positioned precisely under the phosphors. The field emitters and very small, and typically several hundred thousand emitters are provided for each pixel to provide very uniform light emission. The two plates are sealed along the space between the outer rows of dots and the edge of the glass with a separation controlled by internal spacers and the space evacuated to form a vacuum. A field emitter control structure is provided so that any single color sub-pixel on the display can be activated on command, and in this configuration each column of color sub-pixels is connected and routed to the back side of the glass and is referred to as column controls, and the control for each row of pixels is brought to the side and is referred to as row controls. A high voltage is provided between the field emitters and the phosphor front plate to accelerate the electrons released from the field emitters and provide the energy to activate the phosphors.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
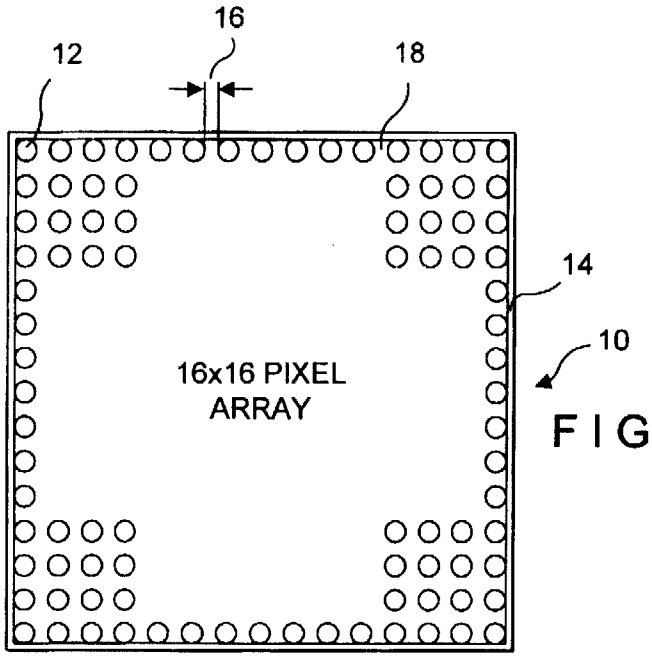
FIG. 1 is a front plan view of a tile of the present invention.
Figure 2:
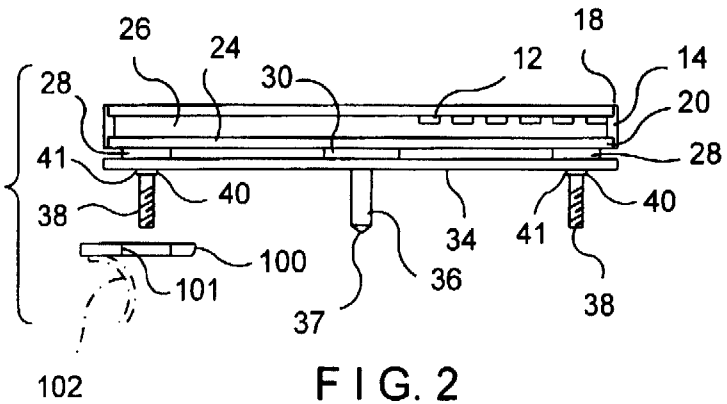
FIG. 2 is a side plan view of the assembled tile of the present invention, along with a method of attachment to the display.

Referring now to the drawings in detail wherein like numerals refer to like elements throughout the several views, one sees that FIG. 1 is a front plan view of a tile 10 including a sixteen (rows) by sixteen (columns) array of pixels 12. Along the periphery of tile 10 is edge seal 14 between the top and bottom plates (elements 18 and 20, respectively, as shown in FIG. 2). The width of edge seal 14 as viewed from above in FIG. 1 is slightly less than one half of the inter-pixel space illustrated by the numeral 16. Similarly, the inter-pixel space 16 is one half of the diameter of any one of pixels 12.

FIG. 2 shows a side view of the assembled tile 10. Top plate 18 is upwardly spaced from and parallel to bottom plate 20. The spacing between top plate 18 and bottom plate 20 is maintained by edge spacer (and frit seal) 14 and internal spacers (not shown). Phosphor pixels 12 are deposited on the underside of transparent top plate 18. Field emitter arrays and row control gates 24 are deposited on the top surface of bottom plate 20 and shown in more detail in FIGS. 4 and 5. A vacuum 26 is formed in the space between the phosphor pixels 12 on top plate 18 and the field emitter arrays and row control gates 24 on the top surface of bottom plate 20. Four spacer/mounting flanges 28 integral with studs 38 are welded or epoxied to a lower side of respective corners of bottom plate 20 and pass through apertures 41 in circuit board 34 thereby providing an attachment thereto. Nuts 40 are threadedly secured to studs 38 to secure circuit board 34 to studs 38. Likewise, flange 30 integral with stem 36 abuts a lower side of bottom plate 20 and passes through an aperture in circuit board 34 thereby providing a passage therethrough. Stem 36 protrudes vertically downward from a midpoint of circuit board 34. Stem 36 is hollow and in communication with the space between top and bottom plates 18, 20 and is used to pull the vacuum during assembly and is sealed thereafter. Stem 36 further provides a path via wire 37 for the anode connection for panel 10.

Figure 7:
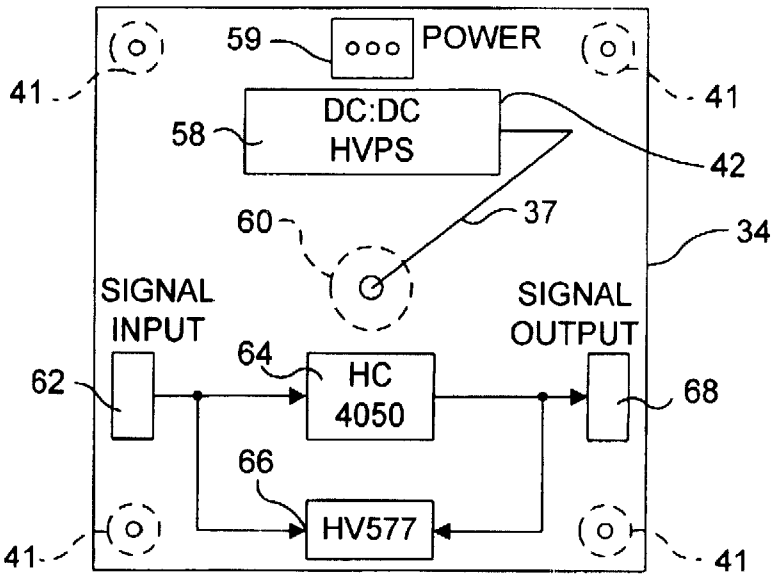
FIG. 7 is a front plan view of the driving electronics as attached to the rear of the tile of the present invention.

Studs 38 protrude vertically downward from points somewhat inward from the corners of circuit board 34 which contains the driving electronics 42 (see FIG. 7). Studs 38 are further used to attach the tile 10 through apertures 101 to a larger mounting frame 100. Typically, studs 38 are serrated and thereby engage serrations on flap 102 which ordinarily impinges against aperture 101 until stud 38 is pushed therethrough thereby pushing flap 102 to a lateral position which engages the lateral sides of stud 38. This allows for removal of any tile from the front of the display. Nuts (not shown) may be used in lieu of such a friction detent configuration in high vibration environments. However, such use of nuts requires access to the rear of the display for servicing.

Figure 3:
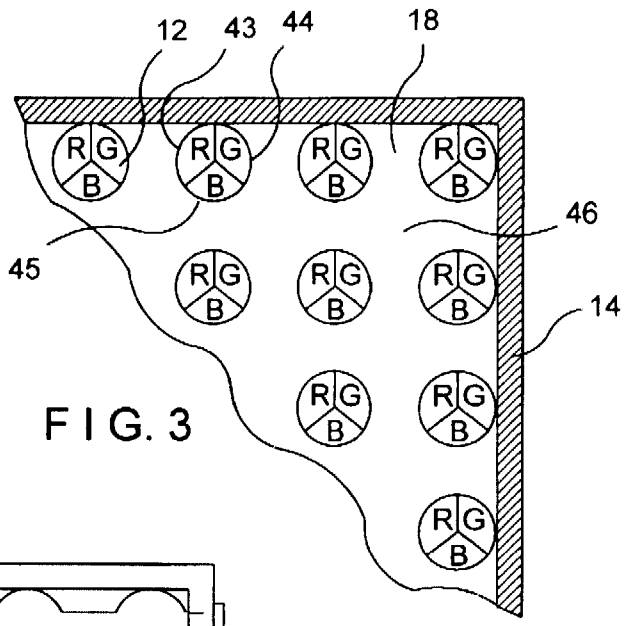
FIG. 3 is a partial front plan view of top plate of the present invention showing the red, green and blue pie-shaped phosphors deposited on the top plate.

FIG. 3 illustrates that pixels 12 are divided into red, green and blue pie-shaped phosphors 43, 44, 45, respectively as deposited on the inner surface of top plate 18.

Figure 4:
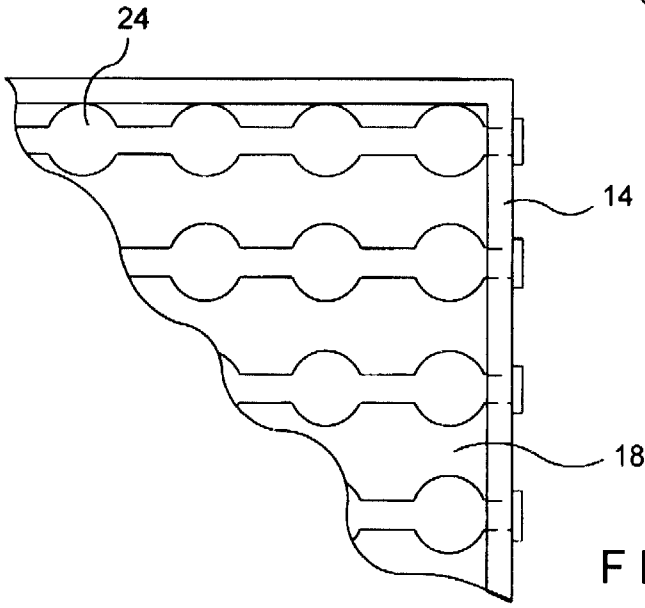
FIG. 4 is a partial front plan view of the present invention showing the row control gates.

FIG. 4 illustrates the row control gate electrodes 24 communicating through edge seal 14 and subsequently between sequential pixels in a row on the inner side of top plate 18.

Figure 5:
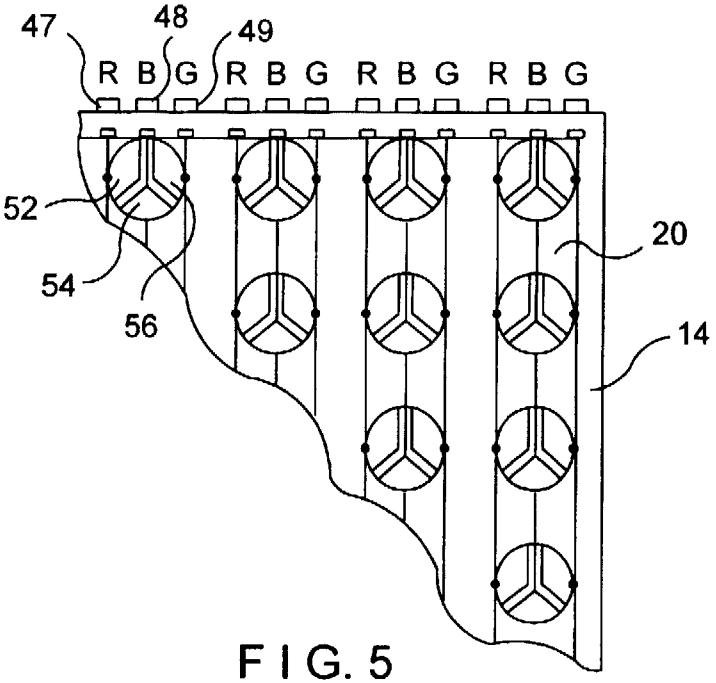
FIG. 5 is a partial front plan view of the column cathodes deposited in a pie shape on the inner surface of the bottom plate of the present invention.

FIG. 5 illustrates the column electrodes (cathodes) 52, 54, 56 deposited in a pie shape on the inner surface of bottom plate 20. The electrical connections are routed through the edge seal 14 to the rear surface via paths 47, 48, 49 for row control gate electrodes for red, blue, and green, respectively.

Figure 6:
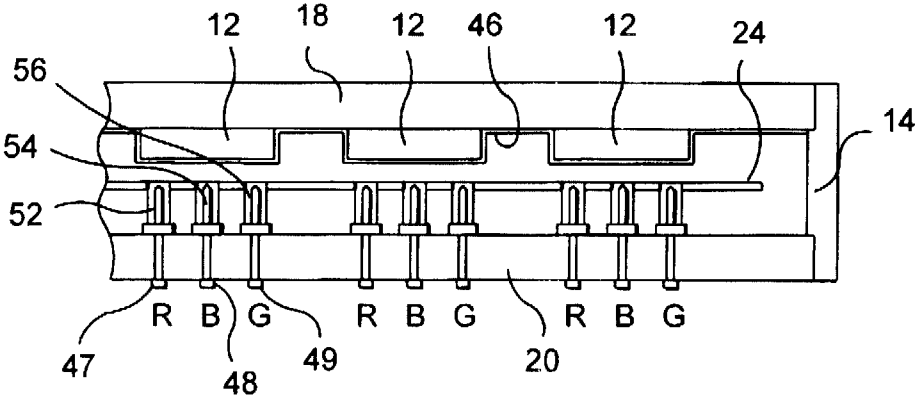
FIG. 6 is a partial side view of the display tile of the present invention.
Figure 8A:
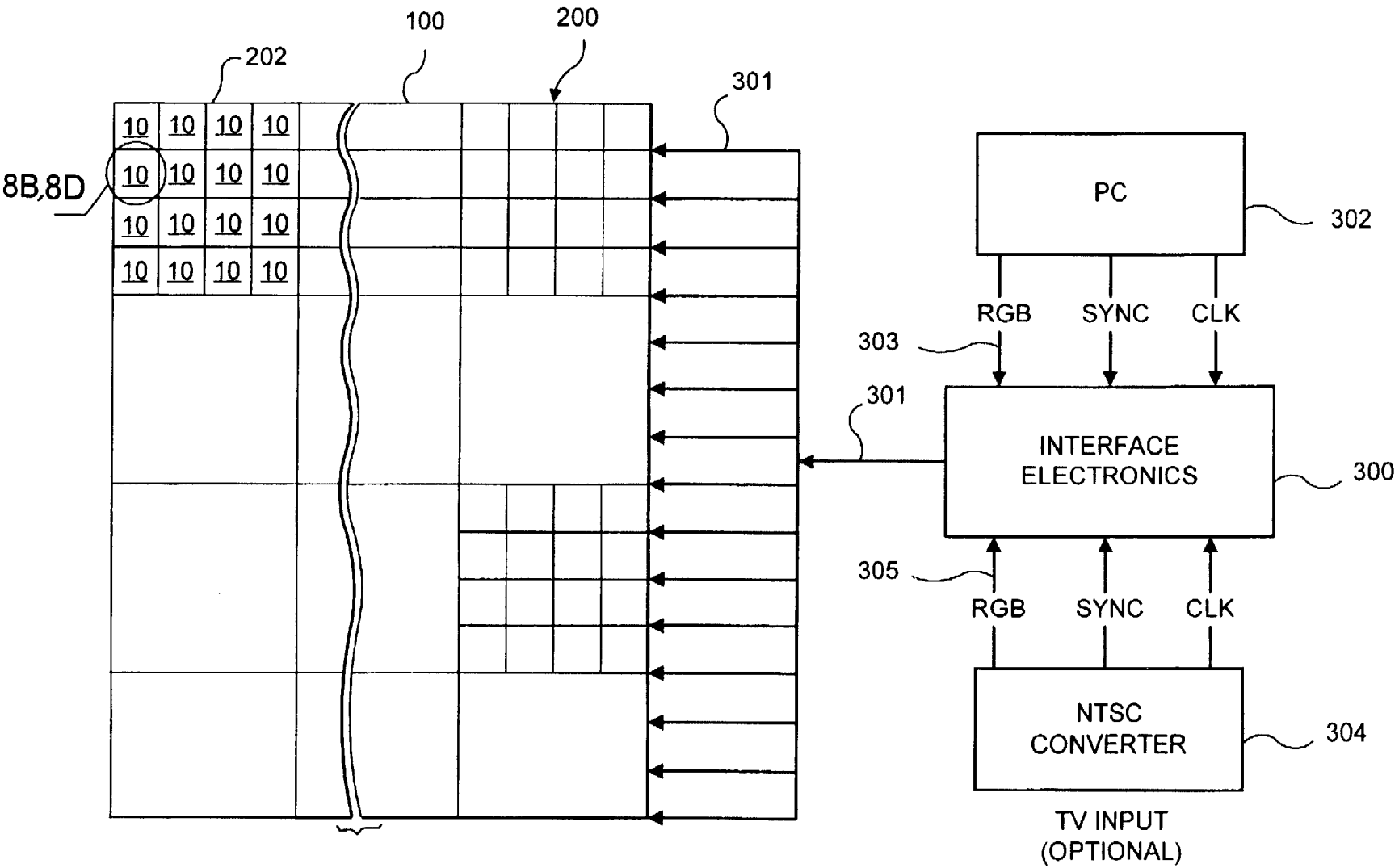
FIG. 8 illustrates how the basic display panel is assembled to a frame to provide a display of the present invention.
Figure 8B:
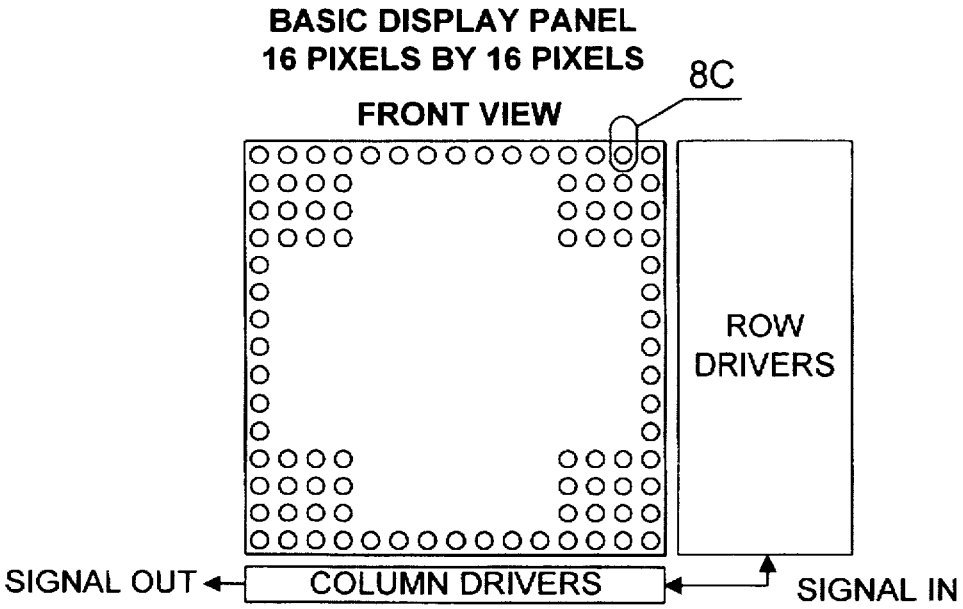
Figure 8C:
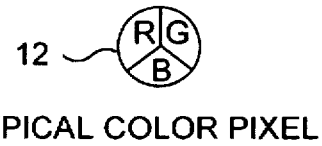
Figure 8D:
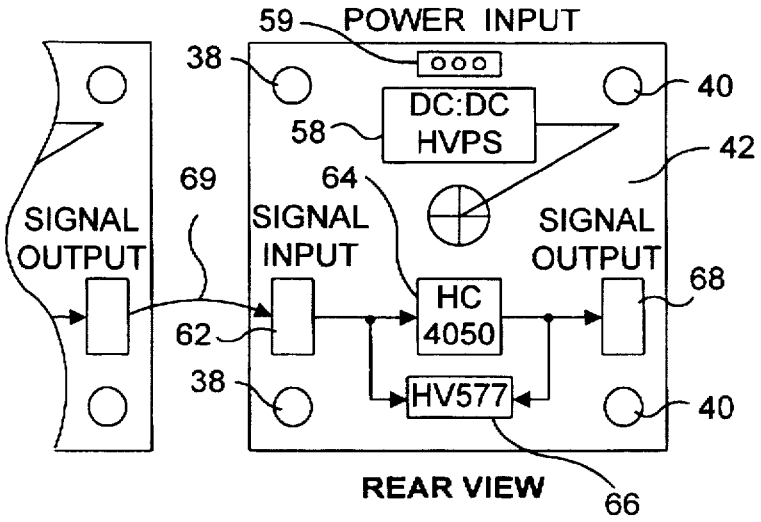

FIG. 6 is a side view illustrating the relationship between the column electrodes (cathodes) 52, 54, 56 on bottom plate 20 which are immediately downwardly adjacently spaced from phosphor pixels 12 which are deposited on the inner surface of top plate 18 and covered by anode metallic film 46. Paths 47, 48, 49 for column electrodes (cathodes) 52, 54, 56 (for red, blue and green, respectively, corresponding to pie-shaped phosphors 43, 45, 44) are routed through edge seal 14 to the lower surface of bottom plate 20 for connection to driving electronics 42. A classic triode is formed with the column cathodes 52, 54, 56, the row control gate electrodes 24 and the anode metallic film 46. As previously stated, wire 37 through stem 36 is used to complete the anode connection to the anode metallic film 46. Electrons are pulled from the field emitters when the gate is positive with respect to the cathode, and is accelerated by the high positive potential on the anode metallic film 46 causing them to impact the color phosphors and emit light through the front surface (see also FIG. 11). The anode metallic film 46 also acts as a reflector returning more light to the front surface.

FIG. 7 illustrates the driving electronics 42 as supported by circuit board 34 which, in turn, is supported by studs 38 (see also FIG. 2). High voltage power supply 58 provides the voltage for the positive anode accelerating potential via wire 37 which extends through stem 36 which passes through aperture 60 in a center position of circuit board 34 connecting to anode metallic film 46. Power supply 58 is in electrical communication with power connector 59. Power connector 59 supplies the five volt logic and medium voltage (approximately 40 volts) required for the gate-to-cathode driving potential. Input signal connector 62 receives the signal input and communicates the same to CMOS signal buffer 64 and to shift register latch and buffer array 66, typically four 16-bit shift registers, see shift registers 76, 80, 82, 84 of array 66 in FIG. 9. CMOS signal buffer 64 and shift register arrays 76, 80, 82, 84 likewise communicate with output signal connector 68.

FIG. 8 illustrates a typical display panel 200 assembled on mounting frame 100 to provide a display of any size, such as 640 pixels by 512 pixels. Display panel 200 is composed of a plurality of panels 202 which each include sixteen (four by four) tiles 10 (see also FIG. 1) and driving electronics 42 (see also FIG. 7). In order obtain the display size of 640 pixels by 512 pixels, ten panels by eight panels 202 are assembled, each panel 202 including sixteen (four by four) tiles 10 with 256 pixels 12.

Interface electronics 300 may be implemented as disclosed in application Ser. No. 08/271,096, entitled "Interface for LED Matrix Display with Buffers with Random Access Input and Direct Memory Access Output", filed on Jul. 6, 1994 based upon application Ser. No. 07/975,676, filed on Nov. 3, 1992. The disclosure of these applications is hereby incorporated by reference.

Interface electronics 300 drives each row of tiles through signal cables 301 to the rightmost column of tiles in display panel 200. The signals are transferred from the output signal connector 68 (see also FIG. 7) of driving electronics 42 of one tile 10 to the input signal connector 62 of the leftwardly adjacent tile over short cables 69. Power is distributed to the power input connectors through distribution cables in a normal fashion well-known in the prior art.

Signals into interface electronics 300 may be from any video source. NTSC converter 304 (other formats are equally applicable) receives television input signals and converts the same to RGB (red, green, blue) data, sync and clock signals and outputs these signals to interface electronics 300 over lines 305. Alternately, personal computer 302 provides similar signals over lines 303. Interface electronics 300 can be configured to display either data source 302 or 304 or combine the two for display as required.

Figure 9:
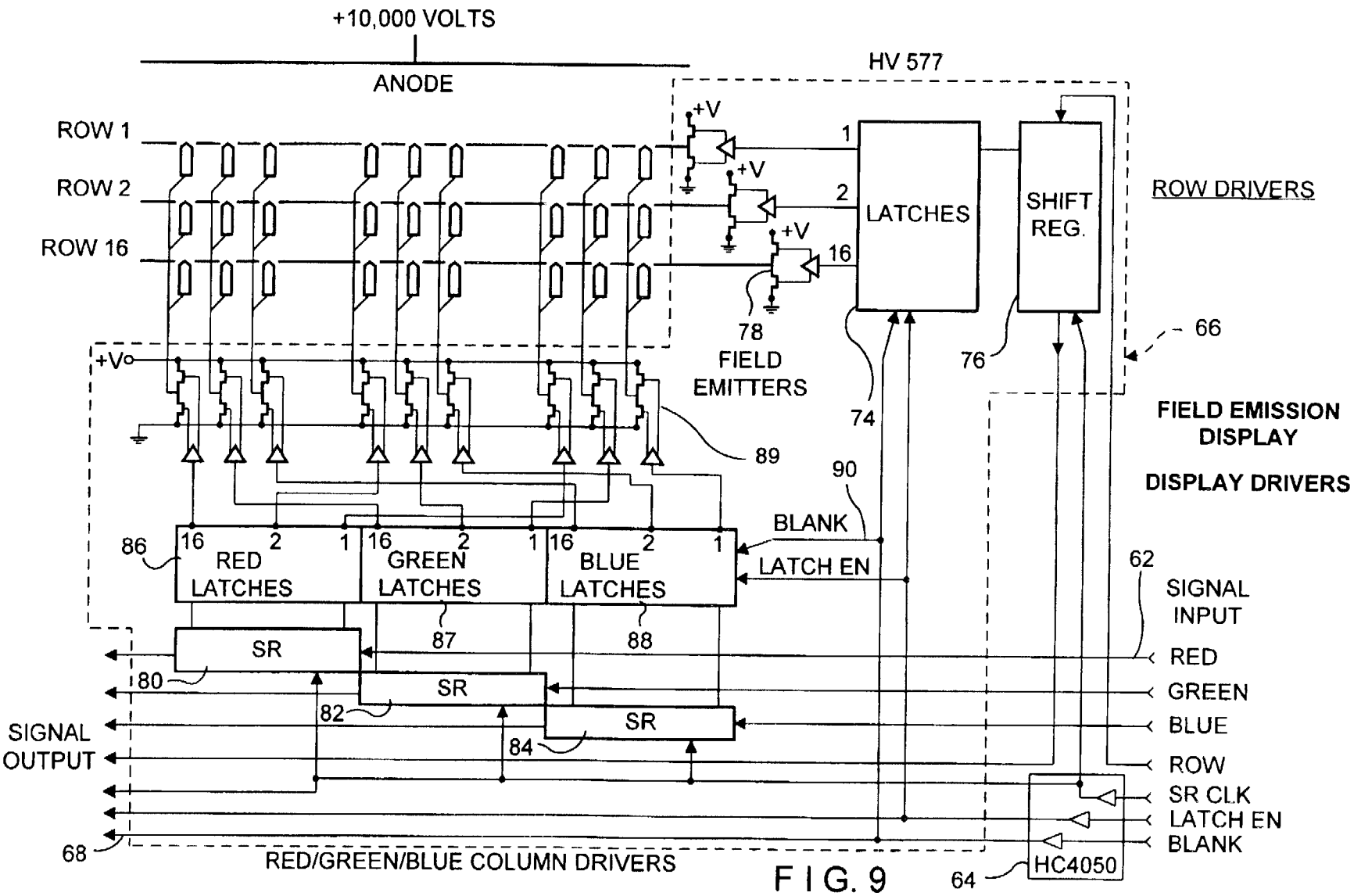
FIG. 9 illustrates the electronic schematic of the shift register array of the present invention.

FIG. 9 is a schematic of shift register latch and buffer array 66 (shown within the dotted lines, see also FIG. 7). Signals, including red data, green data, blue data, row select control, shift register clock, latch enable and display blanking control signals, enter through input signal connector 62. The shift register clock, latch enable and display blanking control signals (not including the row control signal or the color data signals) are buffered by buffer 64 and presented to the output signal connector 68 as well as latch 74 (latch enable control signal and display blanking control signal), latches 86, 87, 88 and shift registers 76, 80, 82 and 84 (shift register clock control signal).

The red, green and blue data signals and the row control signal enter the shift registers 80, 82, 84 and 76, respectively, where the signals are delayed for sixteen shift register clock cycles. The delayed data output of shift registers 76, 80, 82, 84 is output to output signal connector 68. The output of shift registers 80, 82, 84 is likewise sent to red latch 86, green latch 87 and blue latch 88, respectively, while the output of shift register 76 is output to latch 74. The above data is transferred to latches 74, 86, 87, 88 on the rising edge of the latch enable signal. Shift registers 76, 80, 82, 84 and latches 74, 86, 87 and 88 are of conventional CMOS design and are all integral with array 66.

Red latch 86, green latch 87 and blue latch 88 output data to driver assembly (medium voltage buffer) 89 and row control latch 74 outputs data to driver assembly (medium voltage buffer 78) which is designed with high voltage CMOS technology to permit voltage swings on its output of up to 80 volts which provides the gate-to-emitter drive of the field emitter through the row and column drive lines. For a pixel to light, the row control gates must be at a positive potential with respect to the column controlled emitters which must be at a zero potential. This is shown in more detail in FIG. 10 where the status in "ON" only if the row controlled gate is positive and the column controlled emitter is zero. The blank control lead 90, in communication with the display blanking control signal, forces all outputs to the low potential and provides for blanking the entire display panel 200 as well as providing means to control the overall intensity of the display by truncating the display time. Only one of the sixteen rows is allowed to be positive at any one time, while any number or all of the column drivers may be at zero potential. Every sixteenth row is scanned simultaneously, followed by each successive row (i.e., the first, seventeenth, thirty-third, etc. rows are scanned simultaneously, followed by the second, eighteenth, thirty-fourth, etc., followed by the third, nineteenth, thirty-fifth, etc. . . . ), so that at any one time, one sixteenth of the rows are being scanned simultaneously. In operation, red, green, blue and the selected row data is fed into shift registers 80, 82, 84 and 76 in a number of clock cycles equal to sixteen times the number of display panels connected in a row. At the appropriate time, the latch enable control signal transfers the row data to latch 74 and red, green and blue data to latches 86, 87, 88, respectively. While a given row of data is being displayed, the next row of data is transferred into shift registers 80, 82, 84, 76 and awaits its turn for display. The brightness of the display panel 200 depends on how long one row of data is allowed to be displayed. The use of eight bits can provide 256 intensities for each color sub-pixel or over 16 million color combinations.

Interface electronics 300 provides up to eight bits of memory storage for each of the red, green and blue components for each pixel to be displayed. Internal logic displays one entire frame of one intensity bit for one time period, another intensity bit level for a second time period until all the intensity levels have been displayed. Successive time periods have durations different by a factor two. In practice, eight entire fields of data are displayed in one frame time at the rate of sixty frames per second. The brightest pixel will be displayed in all eight time periods and the dimmest in only the shortest time period. The eye is most sensitive to flicker at the lower light levels and the flicker of the display can be reduced by displaying the intensity levels in a non-progressive sequence. A pure random sequence in the display of intensity level fields may be desirable but the complexity of the logic may not be justified if the persistence of the display phosphors is adequate.

Figures 10, 11:
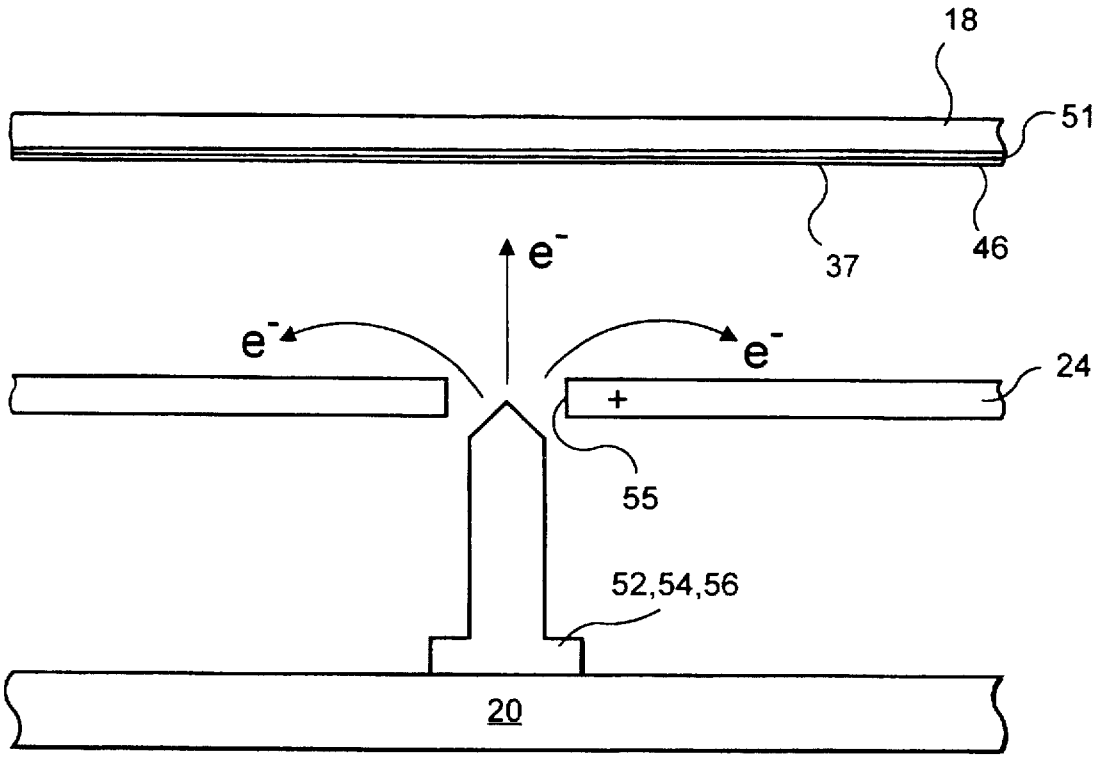
FIG. 10 is a table showing the four possible states of the polarity of the row control gate and column emitters and the resulting status of the pixel in the display of the present invention.
FIG. 11 is a cross-sectional view of the column control and the row control of the present invention, illustrating the process of effecting illumination of a pixel.

FIG. 11 is a cross-sectional view of the column control and the row control of the present invention, illustrating the process of effecting illumination of a color portion of a pixel. Phosphor layer 51, which comprises red, green and blue pie-shaped phosphors 43, 44, 45 thereby forming phosphor pixels 12, is sandwiched between planar top (glass) plate 18 and anode metallic film 46. Row control gate electrode 24 is configured as a horizontal planar element parallel to base plate 20 and film 46, but with an opening 55. There are, of course, millions of column electrodes 52, 54, 56 and millions of openings 55 in a typical display. Column electrode (cathode) 52 (likewise 54 or 56) extends vertically upward from below row control gate electrode 24 toward opening 55. Anode metallic film 46 is typically at a positive potential of 10,000 volts via wire 37 in stem 36. Row control gate electrode 24 is periodically activated (sequentially with adjacent row control gate electrodes 24 'not shown') to a positive potential, while the column electrodes 52 (or 54 or 56) are set at a zero potential simultaneously with the activation of row control gate electrode 24 for the color portion of the pixel desired to be illuminated. When row control gate electrode 24 is at a positive potential and column electrode 52 is at a zero potential, electrons are pulled from column electrode 52 by the positive potential of both the anode metallic film 46 and the row control gate electrode 24. A portion of these electrons are projected vertically upward to impinge upon phosphor layer 51 thereby activating the appropriate color portion of red, green and blue pie-shaped phosphors 43, 44, 45.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A display apparatus including:

a transparent planar sheet with a plurality of discrete pixels, said pixels formed of phosphorescent material;

a planar metallic anode sheet adjacent and parallel to said transparent planar sheet;

planar electrode means parallel to said planar metallic anode sheet and spaced therefrom, said planar electrode means including at least one aperture aligned with each of said pixels;

a plurality of column cathode means extending perpendicular to said planar electrode means and directed toward each said at least one aperture;

means for maintaining said planar metallic anode sheet at a first positive potential, and means for selectively maintaining said planar electrode means at a second positive potential with respect to said column cathode means, whereby electrons from said column cathode are directed to said pixels thereby illuminating said phosphorescent material;

output means for controlling said discrete pixels;

memory means in communication with said output means, said memory means including a first buffer and a second buffer for receiving digital video data;

logic means for inputting said video data to said memory means in random access order so that a frame includes M groups of m consecutive lines, wherein like order data from each of said M groups is stored in M consecutive bytes in said memory means and further so that data is stored in an order which the data is to be output from said memory means, thereby implementing direct memory access of said memory means, said logic means further including means for outputting data from said memory means in parallel through a plurality of paths to output means, wherein like order data from each of said M groups is directed to said output means substantially simultaneously.

2. The display apparatus of claim 1 wherein said discrete pixels are arranged in rows and columns, and wherein said planar electrode means is comprised of a plurality of electrodes, each of said plurality of electrodes corresponding to a row of pixels.

3. The display apparatus of claim 2 wherein said plurality of electrodes are activated sequentially.

4. The display apparatus of claim 3 wherein each of said plurality of pixels is separated from an adjacent pixel by a preselected interpixel distance and wherein outer pixels on said display are separated from an edge of said display by one half of said preselected interpixel distance.

5. The display apparatus of claim 1 further including a planar sheet spaced below said column cathode means and means for sealing between said planar transparent sheet and said lower planar sheet whereby a vacuum is induced therebetween.

6. A display apparatus comprised of a plurality of tiles, each of said plurality of tiles comprising:

a transparent planar sheet with a plurality of discrete pixels, said pixels formed of phosphorescent material;

a planar metallic anode sheet adjacent and parallel to said transparent planar sheet;

planar electrode means parallel to said planar metallic anode sheet and spaced therefrom, said planar electrode means including at least one aperture aligned with each of said pixels;

a plurality of column cathode means extending perpendicular to said planar electrode means and directed toward each said at least one aperture;

means for maintaining said planar metallic anode sheet at a first positive potential, and means for selectively maintaining said planar electrode means at a second positive potential with respect to said column cathode means, whereby electrons from said column cathode are directed to said pixels thereby illuminating said phosphorescent material;

output means for controlling said discrete pixels;

memory means in communication with said output means, said memory means including a first buffer and a second buffer for receiving digital video data;

logic means for inputting said video data to said memory means in random access order so that a frame includes M groups of m consecutive lines, wherein like order data from each of said M groups is stored in M consecutive bytes in said memory means and further so that data is stored in an order which the data is to be output from said memory means, thereby implementing direct memory access of said memory means, said logic means further including means for outputting data from said memory means in parallel through a plurality of paths to output means, wherein like order data from each of said M groups is directed to said output means substantially simultaneously.

7. The display apparatus of claim 6 wherein said discrete pixels are arranged in rows and columns, and wherein said planar electrode means is comprised of a plurality of electrodes, each of said plurality of electrodes corresponding to a row of pixels.

8. The display apparatus of claim 7 wherein said rows are divided into groups of a given number of rows, and the rows are sequentially scanned within a group by activating all pixels within a row simultaneously.

9. The display apparatus of claim 8 wherein each of said plurality of pixels is separated from an adjacent pixel by a preselected interpixel distance and wherein outer pixels on said tile are separated from an edge of said tile by one half of said preselected interpixel distance.

10. The display apparatus of claim 6 further including a planar sheet spaced below said column cathode means and means for sealing between said planar transparent sheet and said lower planar sheet whereby a vacuum is induced therebetween.

* * * * *